US009305502B2

(12) United States Patent
Guo et al.

(10) Patent No.: US 9,305,502 B2
(45) Date of Patent: Apr. 5, 2016

(54) ADJUSTING METHOD OF GAMMA VOLTAGE ADJUSTING DEVICE

(71) Applicant: SHENZHEN CHINA STAR OPTOELECTRONICS TECHNOLOGY CO., LTD., Shenzhen (CN)

(72) Inventors: Dongsheng Guo, Shenzhen (CN); Ye Dai, Shenzhen (CN)

(73) Assignee: SHENZHEN CHINA STAR OPTOELECTRONICS TECHNOLOGY CO., LTD, Shenzhen (CN)

( * ) Notice: Subject to any disclaimer, the term of this patent is extended or adjusted under 35 U.S.C. 154(b) by 324 days.

(21) Appl. No.: 14/233,158

(22) PCT Filed: Nov. 13, 2013

(86) PCT No.: PCT/CN2013/086995
§ 371 (c)(1),
(2) Date: Jan. 16, 2014

(87) PCT Pub. No.: WO2015/066938
PCT Pub. Date: May 14, 2015

(65) Prior Publication Data

US 2016/0035296 A1 Feb. 4, 2016

(30) Foreign Application Priority Data

Nov. 8, 2013 (CN) ..... 2013 1 0553975

(51) Int. Cl.
*G09G 3/36* (2006.01)

(52) U.S. Cl.
CPC ..... *G09G 3/3614* (2013.01); *G09G 3/3611* (2013.01); *G09G 3/3648* (2013.01); *G09G 2310/08* (2013.01); *G09G 2320/0673* (2013.01)

(58) Field of Classification Search
CPC . G09G 3/3614; G09G 3/3688; G09G 3/3696; G09G 3/3291; G09G 3/3648; G09G 3/006
See application file for complete search history.

(56) References Cited

U.S. PATENT DOCUMENTS

2006/0221029 A1* 10/2006 Hsu ..... G09G 3/3614 345/88
2007/0182683 A1* 8/2007 Chin ..... G09G 3/3688 345/88

* cited by examiner

*Primary Examiner* — Gerald Johnson
(74) *Attorney, Agent, or Firm* — Mark M. Friedman

(57) ABSTRACT

Disclosed is an adjusting method of a gamma voltage adjusting device. The gamma voltage adjusting device is utilized for providing a liquid crystal panel with N gray levels and includes a printed circuit board assembly and a gamma voltage fine-tuning unit. The adjusting method of the gamma voltage adjusting device includes: generating N+2 gamma voltages with the printed circuit board assembly; inputting the N+2 gamma voltages to the gamma voltage fine-tuning unit; and generating negative polarity driving voltages and positive polarity driving voltages which are symmetrical according to the N+2 gamma voltages. The present invention decreases a number of gamma integrated circuits on the printed circuit board assembly for saving cost by decreasing the 2N gamma voltages in the prior arts to the N+2 gamma voltages.

12 Claims, 9 Drawing Sheets

ADJUSTING METHOD OF GAMMA VOLTAGE ADJUSTING DEVICE

BACKGROUND OF THE INVENTION

1. Field of the Invention

The present invention generally relates to an adjusting method, and more particularly to an adjusting method of a gamma voltage adjusting device.

2. Description of Prior Art

In a liquid crystal display device, there are two methods for adjusting gamma voltages. A first method is to adjust the gamma voltages by hardware. A second method is to adjust the gamma voltages by software, such as a timing controller (T-con) for adjusting data. Please refer to FIG. 1 and FIG. 2. FIG. 1 illustrates a method for adjusting the gamma voltages by hardware in the prior arts. FIG. 2 illustrates relationships of the gamma voltages and transmittances in the prior arts. Taking 256 gray levels for example, a printed circuit board assembly (PCBA) 10 firstly generates 2N gamma voltages, which comprises N negative polarity gamma voltages GMA1-GMAN and N positive polarity gamma voltages GMAN+1-GMA2N. The N negative polarity gamma voltages GMA1-GMAN and the N positive polarity gamma voltages GMAN+1-GMA2N are inputted to a data chip 12. The data chip 12 generates 256 negative polarity driving voltages V255-V0 according to the N negative polarity gamma voltages GMA1-GMAN and generates 256 positive polarity driving voltages V0'-V255' according to the N positive polarity gamma voltages GMAN+1-GMA2N. The negative polarity driving voltages V255-V0 and the positive polarity driving voltages V0'-V255' are utilized for driving pixels to display one of the 256 gray levels.

It can be understood from FIG. 2 that the N negative polarity gamma voltages GMA1-GMAN and the N positive polarity gamma voltages GMAN+1-GMA2N are generated in pair. That is, each of the gray levels is controlled by two gamma voltages (a negative polarity gamma voltage and a positive polarity gamma voltage), so as to adjust the gray levels to be close to a gamma curve and ensure that the N negative polarity gamma voltages GMA1-GMAN and the N positive polarity gamma voltages GMAN+1-GMA2N in FIG. 2 are symmetrical with respect to a common voltage VCOM. The gray levels can be adjusted to be close to the gamma curve by adjusting the data chip 12. The N negative polarity gamma voltages GMA1-GMAN and the N positive polarity gamma voltages GMAN+1-GMA2N need to be symmetrical with respect to the common voltage VCOM by utilizing the printed circuit board assembly 10 to generate the 2N gamma voltages. Since the 2N gamma voltages of the printed circuit board assembly 10 are generated by gamma integrated circuits (gamma ICs), a number of the required gamma integrated circuits is a burden of cost.

Consequently, there is a need to solve the problem that the cost cannot be reduced because the number of the gamma integrated circuits cannot be decreased in the prior arts.

SUMMARY OF THE INVENTION

An objective of the present invention is to provide an adjusting method of a gamma voltage adjusting device which is capable of decreasing a number of gamma integrated circuits for reducing cost.

To solve the above-mentioned problem, in an adjusting method of a gamma voltage adjusting device provided by the present invention, the gamma voltage adjusting device is utilized for providing a liquid crystal panel with N gray levels and comprises a printed circuit board assembly and a gamma voltage fine-tuning unit. The adjusting method of the gamma voltage adjusting device comprises: the printed circuit board assembly comprising a plurality of gamma integrated circuits for generating N+2 gamma voltages, the N+2 gamma voltages comprising 2 first polarity gamma voltages and N second polarity gamma voltages, the 2 first polarity gamma voltages respectively corresponding to a highest gray level and a lowest gray level of the N gray levels, and the N second polarity gamma voltages respectively corresponding to the N gray levels; inputting the 2 first polarity gamma voltages and the N second polarity gamma voltages to the gamma voltage fine-tuning unit; and generating M first polarity driving voltages or N first polarity driving voltages according to the 2 first polarity gamma voltages and generating N second polarity driving voltages according to the N second polarity gamma voltages with the gamma voltage fine-tuning unit. M is less than or equal to N.

In the adjusting method of the gamma voltage adjusting device, the gamma voltage fine-tuning unit comprises a plurality of resistors, and the gamma voltage fine-tuning unit generates the first polarity driving voltages and the second polarity driving voltages by utilizing the resistors to perform a voltage division.

In the adjusting method of the gamma voltage adjusting device, the gamma voltage fine-tuning unit directly generates the N first polarity driving voltages which are symmetrical to the N second polarity driving voltages according to the 2 first polarity gamma voltages.

In the adjusting method of the gamma voltage adjusting device, the gamma voltage fine-tuning unit generates the M first polarity driving voltages according to the 2 first polarity gamma voltages, and a timing controller adjusts the M first polarity driving voltages to the N first polarity driving voltages which are symmetrical to the N second polarity driving voltages.

To solve the above-mentioned problem, in an adjusting method of a gamma voltage adjusting device provided by the present invention, the gamma voltage adjusting device is utilized for providing a liquid crystal panel with N gray levels and comprises a printed circuit board assembly and a gamma voltage fine-tuning unit. The adjusting method of the gamma voltage adjusting device comprises: generating N+2 gamma voltages with the printed circuit board assembly, the N+2 gamma voltages comprising 2 negative polarity gamma voltages and N positive polarity gamma voltages, the 2 negative polarity gamma voltages respectively corresponding to a highest gray level and a lowest gray level of the N gray levels, and the N positive polarity gamma voltages respectively corresponding to the N gray levels; inputting the 2 negative polarity gamma voltages and the N positive polarity gamma voltages to the gamma voltage fine-tuning unit; and generating M negative polarity driving voltages or N negative polarity driving voltages according to the 2 negative polarity gamma voltages and generating N positive polarity driving voltages according to the N positive polarity gamma voltages with the gamma voltage fine-tuning unit. M is less than or equal to N.

In the adjusting method of the gamma voltage adjusting device, the gamma voltage fine-tuning unit comprises a plurality of resistors, and the gamma voltage fine-tuning unit generates the negative polarity driving voltages and the positive polarity driving voltages by utilizing the resistors to perform a voltage division.

In the adjusting method of the gamma voltage adjusting device, the gamma voltage fine-tuning unit directly generates the N negative polarity driving voltages which are symmetrical to the N positive polarity driving voltages according to the 2 negative polarity gamma voltages.

In the adjusting method of the gamma voltage adjusting device, the gamma voltage fine-tuning unit generates the M negative polarity driving voltages according to the 2 negative polarity gamma voltages, and a timing controller adjusts the M negative polarity driving voltages to the N negative polarity driving voltages which are symmetrical to the N positive polarity driving voltages.

To solve the above-mentioned problem, in an adjusting method of a gamma voltage adjusting device provided by the present invention, the gamma voltage adjusting device is utilized for providing a liquid crystal panel with N gray levels and comprises a printed circuit board assembly and a gamma voltage fine-tuning unit. The adjusting method of the gamma voltage adjusting device comprises: generating N+2 gamma voltages with the printed circuit board assembly, the N+2 gamma voltages comprising 2 positive polarity gamma voltages and N negative polarity gamma voltages, the 2 positive polarity gamma voltages respectively corresponding to a highest gray level and a lowest gray level of the N gray levels, and the N negative polarity gamma voltages respectively corresponding to the N gray levels; inputting the 2 positive polarity gamma voltages and the N negative polarity gamma voltages to the gamma voltage fine-tuning unit; and generating M positive polarity driving voltages or N positive polarity driving voltages according to the 2 positive polarity gamma voltages and generating N negative polarity driving voltages according to the N negative polarity gamma voltages with the gamma voltage fine-tuning unit. M is less than or equal to N.

In the adjusting method of the gamma voltage adjusting device, the gamma voltage fine-tuning unit comprises a plurality of resistors, and the gamma voltage fine-tuning unit generates the negative polarity driving voltages and the positive polarity driving voltages by utilizing the resistors to perform a voltage division.

In the adjusting method of the gamma voltage adjusting device, the gamma voltage fine-tuning unit directly generates the N positive polarity driving voltages which are symmetrical to the N negative polarity driving voltages according to the 2 positive polarity gamma voltages.

In the adjusting method of the gamma voltage adjusting device, the gamma voltage fine-tuning unit generates the M positive polarity driving voltages according to the 2 positive polarity gamma voltages, and a timing controller adjusts the M positive polarity driving voltages to the N positive polarity driving voltages which are symmetrical to the N negative polarity driving voltages.

Compared with the prior arts, the adjusting method of the gamma voltage adjusting device of the present invention decreases the number of the gamma integrated circuits on the printed circuit board assembly for saving the cost by decreasing the 2N gamma voltages in the prior arts to the N+2 gamma voltages.

For a better understanding of the aforementioned content of the present invention, preferable embodiments are illustrated in accordance with the attached figures for further explanation:

DETAILED DESCRIPTION OF THE INVENTION

The following descriptions for the respective embodiments are specific embodiments capable of being implemented for illustrations of the present invention with referring to appended figures.

Figure 3:
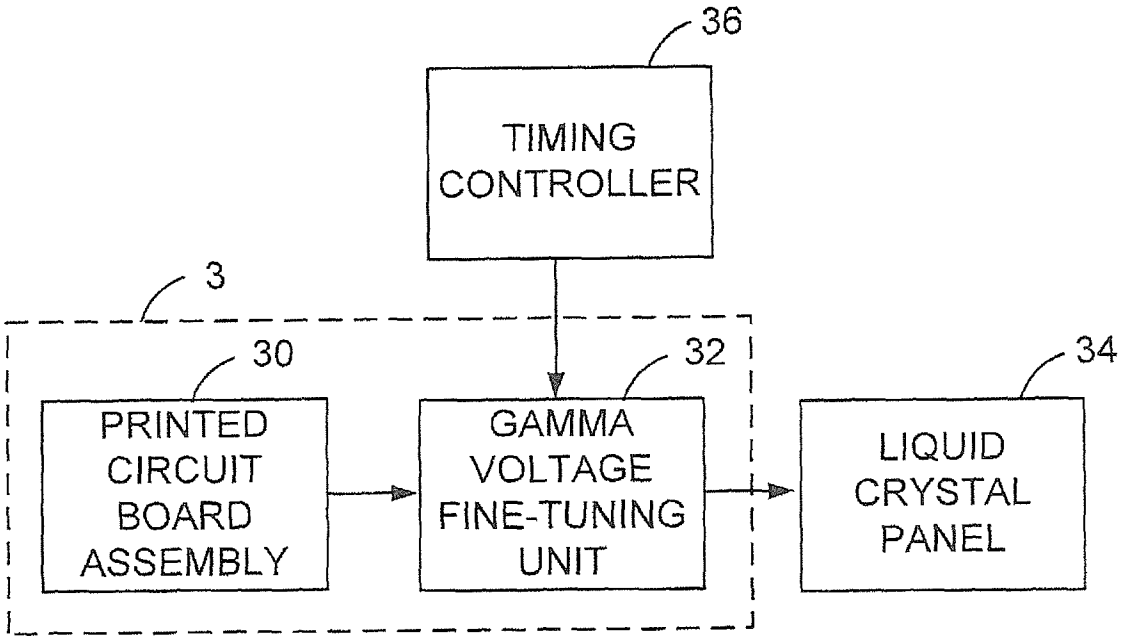
FIG. 3 illustrates a gamma voltage adjusting device, a liquid crystal panel, and a timing controller in accordance with an embodiment of the present invention.
Figure 4:
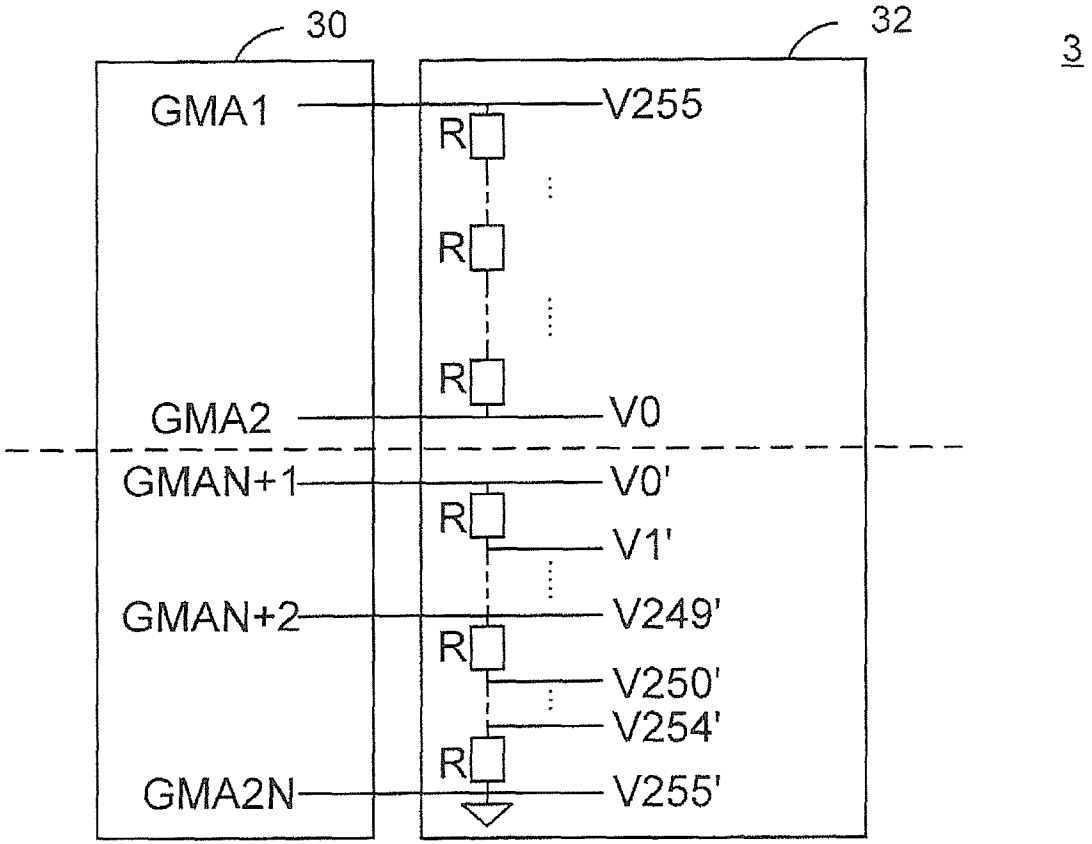
FIG. 4 illustrates the gamma voltage adjusting device in accordance with a first embodiment of the present invention.
Figure 5:
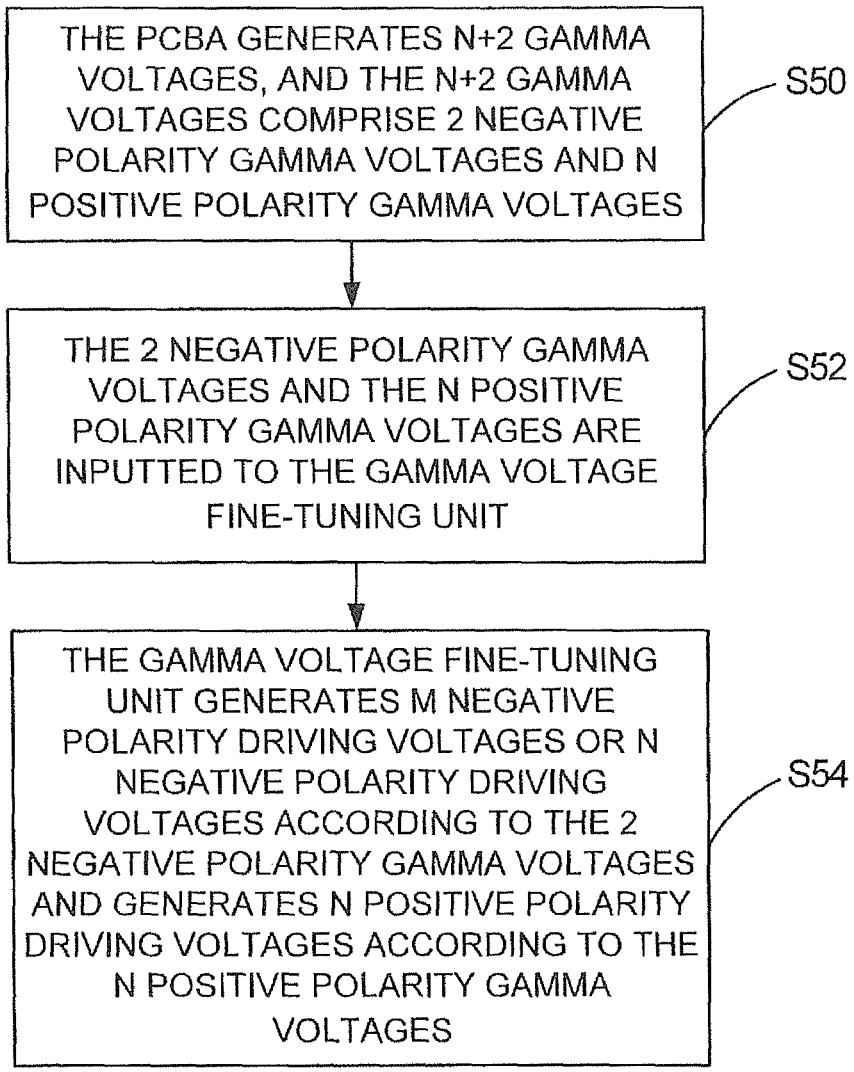
FIG. 5 illustrates a flow chart of an adjusting method of the gamma voltage adjusting device in accordance with the first embodiment of the present invention.

Please refer to FIG. 3 to FIG. 5. FIG. 3 illustrates a gamma voltage adjusting device 3, a liquid crystal panel 34, and a timing controller 36 in accordance with an embodiment of the present invention. FIG. 4 illustrates the gamma voltage adjusting device 3 in accordance with a first embodiment of the present invention. FIG. 5 illustrates a flow chart of an adjusting method of the gamma voltage adjusting device 3 in accordance with the first embodiment of the present invention. The gamma voltage adjusting device 3 is utilized for providing the liquid crystal panel 34 with N gray levels. The gamma voltage adjusting device 3 comprises a printed circuit board assembly (PCBA) 30 and a gamma voltage fine-tuning unit 32. The gamma voltage fine-tuning unit 32, for example, is a data chip. The gamma voltage fine-tuning unit 32 comprises a plurality of resistors R.

In step S50, the PCBA 30 generates N+2 gamma voltages, and the N+2 gamma voltages comprise 2 negative polarity gamma voltages GMA1-GMA2 and N positive polarity gamma voltages GMAN+1-GMA2N. The 2 negative polarity gamma voltages GMA1-GMA2 are respectively corresponding to a highest gray level and a lowest gray level of the N gray levels. The N positive polarity gamma voltages GMAN+1-GMA2N are respectively corresponding to the N gray levels.

Figure 1:
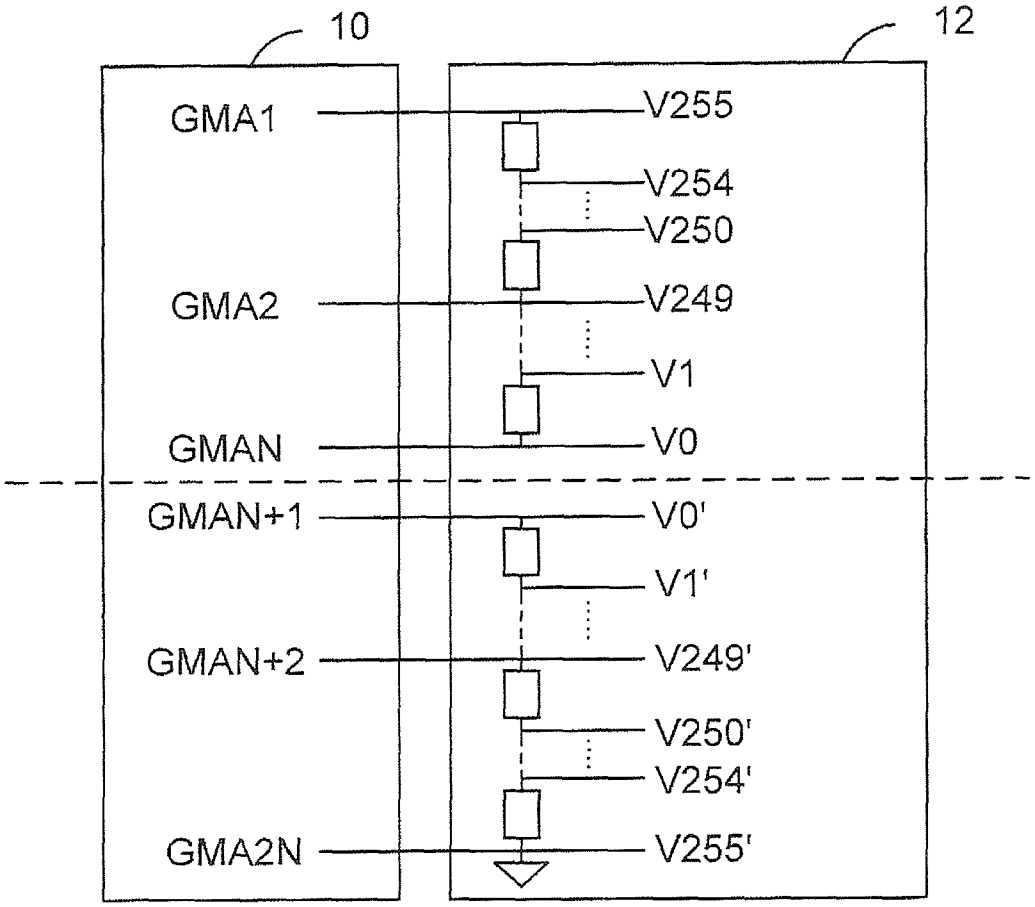
FIG. 1 (PRIOR ART)
FIG. 1 illustrates a method for adjusting the gamma voltages by hardware in the prior arts.
Figure 2:
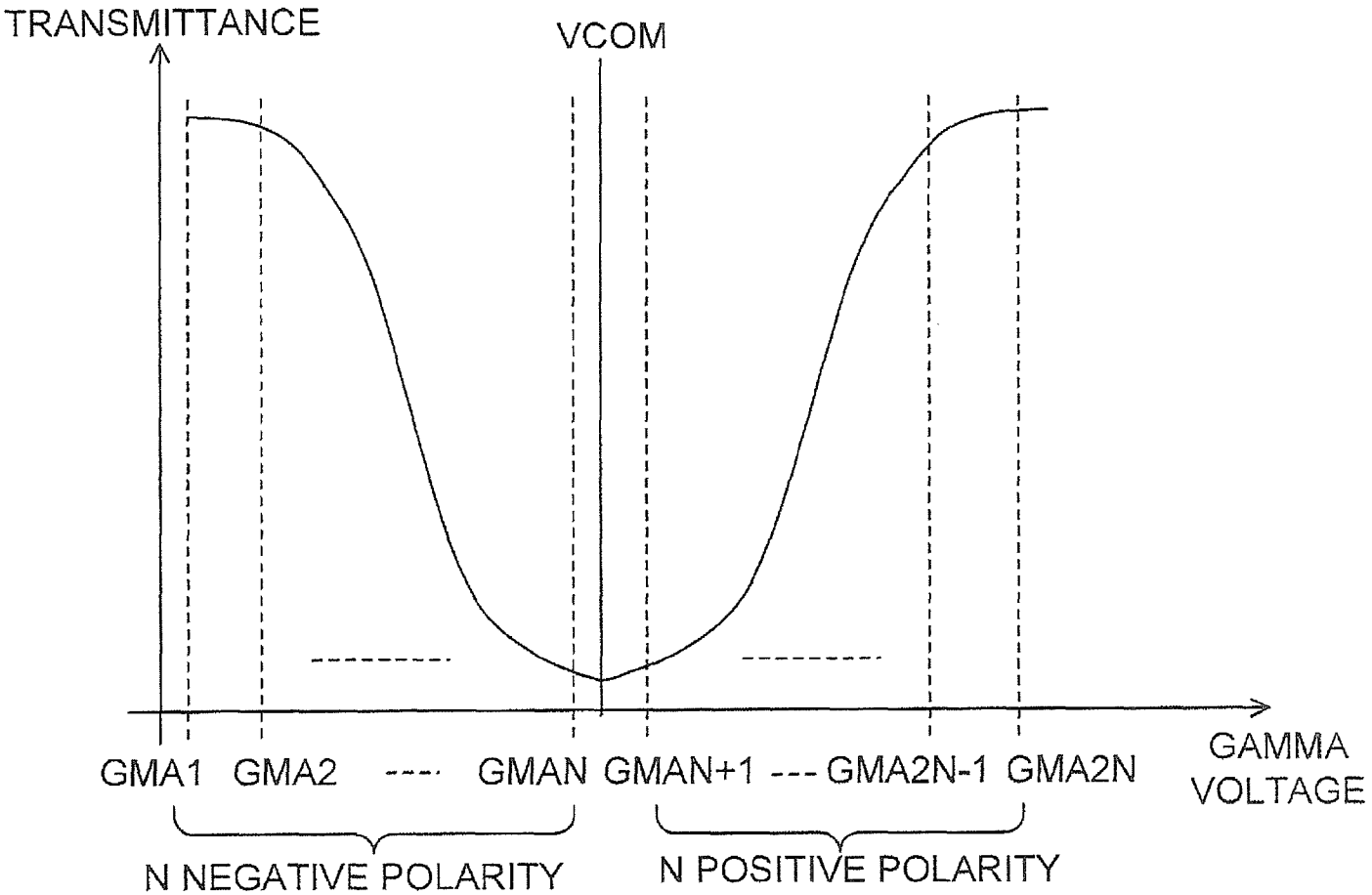
FIG. 2 (PRIOR ART)
FIG. 2 illustrates relationships of gamma voltages and transmittances in the prior arts.

The PCBA 30 comprises a plurality of gamma integrated circuits (gamma ICs, not shown) for generating the N+2 gamma voltages. Since only the N+2 gamma voltages are required in the present invention, a number of the gamma ICs (not shown) can be significantly decreased and cost of the PCBA 30 can be saved when compared with the prior arts in FIG. 1.

In step S52, the 2 negative polarity gamma voltages GMA1-GMA2 and the N positive polarity gamma voltages GMAN+1-GMAN+2 are inputted to the gamma voltage fine-tuning unit 32.

In step S54, the gamma voltage fine-tuning unit 32 generates M negative polarity driving voltages or N negative polarity driving voltages according to the 2 negative polarity gamma voltages GMA1-GMA2 and generates N positive polarity driving voltages according to the N positive polarity gamma voltages GMAN+1-GMAN+2. M is less than or equal to N. More particularly, the gamma voltage fine-tuning unit 32 generates the negative polarity driving voltages and the positive polarity driving voltages by utilizing the resistors R to perform a voltage division.

In one embodiment, the gamma voltage fine-tuning unit 32 directly generates the N negative polarity driving voltages which are symmetrical to the N positive polarity driving voltages according to the 2 negative polarity gamma voltages GMA1-GMA2.

In another embodiment, the gamma voltage fine-tuning unit 32 generates the M negative polarity driving voltages according to the 2 negative polarity gamma voltages GMA1-GMA2, and then the timing controller 36 electrically coupled to the gamma voltage fine-tuning unit 32 adjusts the M negative polarity driving voltages to the N negative polarity driving voltages which are symmetrical to the N positive polarity driving voltages.

Figure 6:
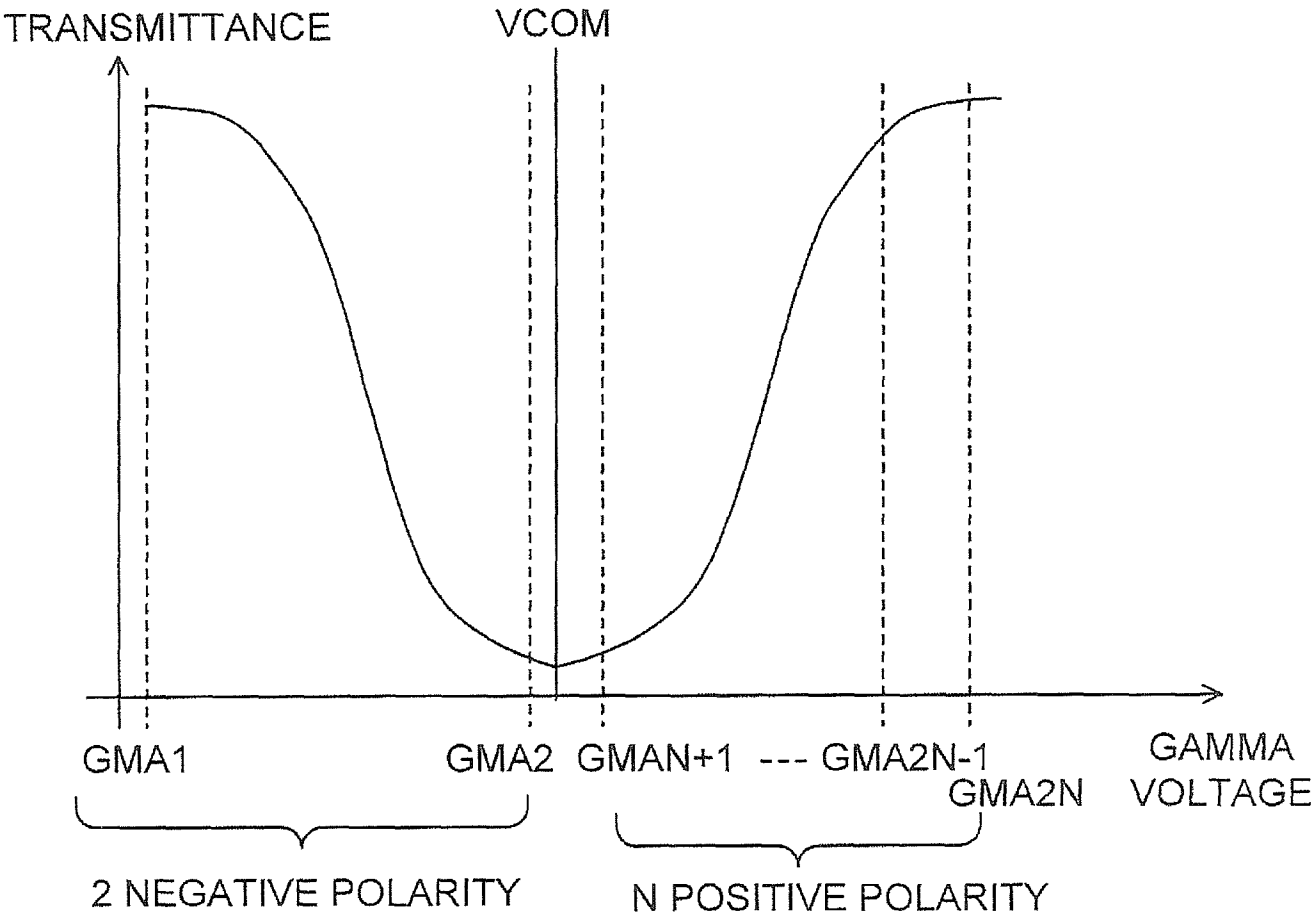
FIG. 6 illustrates relationships of transmittances, the 2 negative polarity gamma voltages GMA1-GMA2, and the N positive polarity gamma voltages GMAN+1-GMA2N in accordance with the first embodiment of the present invention.

FIG. 6 illustrates relationships of transmittances, the 2 negative polarity gamma voltages GMA1-GMA2, and the N positive polarity gamma voltages GMAN+1-GMA2N in accordance with the first embodiment of the present invention.

Figure 7:
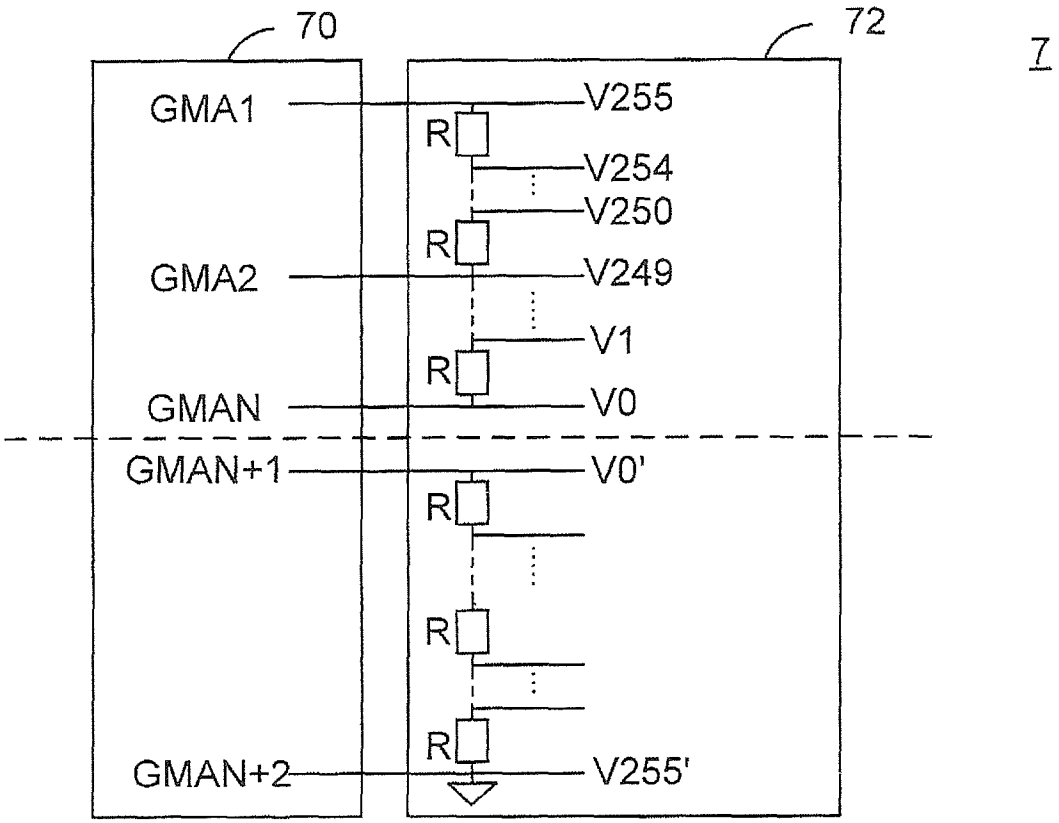
FIG. 7 illustrates a gamma voltage adjusting device in accordance with a second embodiment of the present invention.
Figure 8:
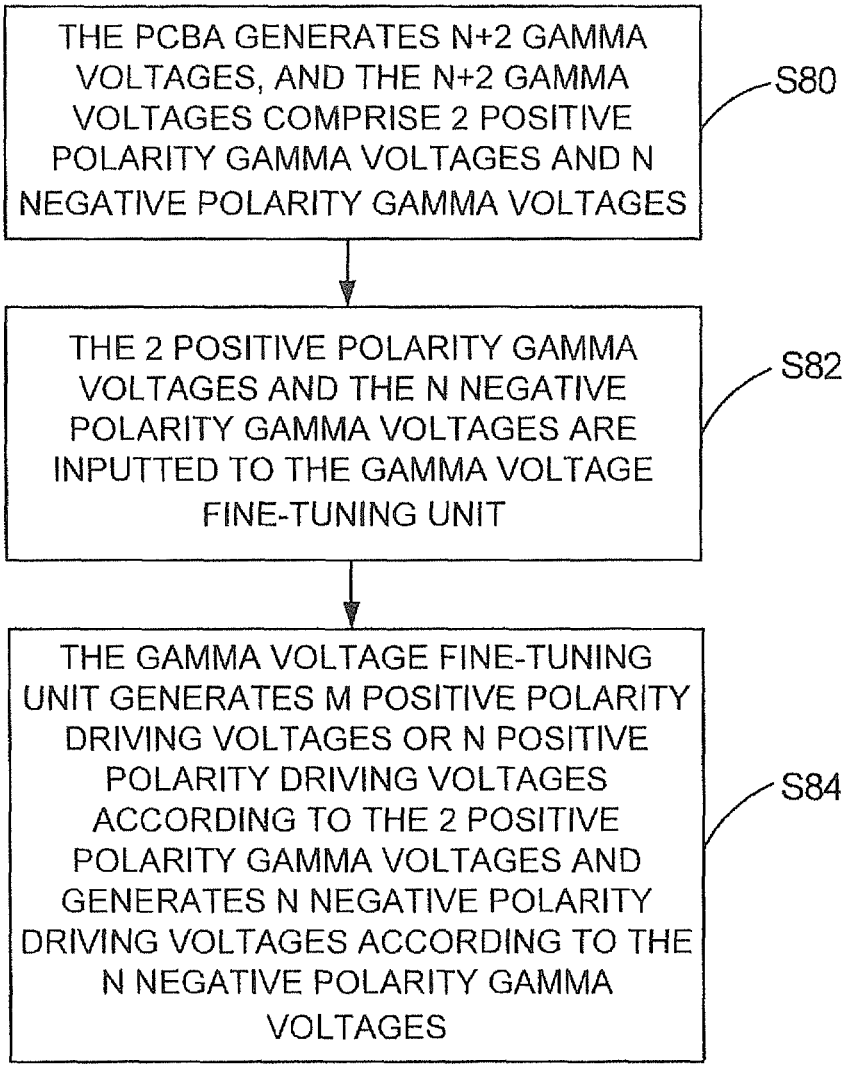
FIG. 8 illustrates a flow chart of an adjusting method of the gamma voltage adjusting device in accordance with the second embodiment of the present invention.

Please refer to FIG. 3, FIG. 7, and FIG. 8. FIG. 7 illustrates a gamma voltage adjusting device 7 in accordance with a second embodiment of the present invention. FIG. 8 illustrates a flow chart of an adjusting method of the gamma voltage adjusting device 7 in accordance with the second embodiment of the present invention. The gamma voltage adjusting device 7 is the same as the gamma voltage adjusting device 3 in FIG. 3 and utilized for providing the liquid crystal panel 34 with N gray levels. The gamma voltage adjusting device 7 comprises a printed circuit board assembly (PCBA) 70 and a gamma voltage fine-tuning unit 72. The gamma voltage fine-tuning unit 72, for example, is a data chip. The gamma voltage fine-tuning unit 72 comprises a plurality of resistors R.

In step S80, the PCBA 70 generates N+2 gamma voltages, and the N+2 gamma voltages comprise 2 positive polarity gamma voltages GMAN+1-GMAN+2 and N negative polarity gamma voltages GMA1-GMAN. The 2 positive polarity gamma voltages GMAN+1-GMAN+2 are respectively corresponding to a highest gray level and a lowest gray level of the N gray levels. The N negative polarity gamma voltages GMA1-GMAN are respectively corresponding to the N gray levels.

Similar to the first embodiment, only the 2 positive polarity gamma voltages GMAN+1-GMAN+2 are required in the second embodiment of the present invention, and a total of the N+2 gamma voltages are required. Compared with the prior arts in FIG. 1, a number of gamma ICs can be significantly decreased, thereby saving cost of the PCBA 70.

In step S82, the 2 positive polarity gamma voltages GMAN+1-GMAN+2 and the N negative polarity gamma voltages GMA1-GMAN are inputted to the gamma voltage fine-tuning unit 72.

In step S84, the gamma voltage fine-tuning unit 72 generates M positive polarity driving voltages or N positive polarity driving voltages according to the 2 positive polarity gamma voltages GMAN+1-GMAN+2 and generates N negative polarity driving voltages according to the N negative polarity gamma voltages GMA1-GMAN. M is less than or equal to N. More particularly, the gamma voltage fine-tuning unit 72 generates the negative polarity driving voltages and the positive polarity driving voltages by utilizing the resistors R to perform a voltage division.

In one embodiment, the gamma voltage fine-tuning unit 72 directly generates the N positive polarity driving voltages which are symmetrical to the N negative polarity driving voltages according to the 2 positive polarity gamma voltages GMAN+1-GMAN+2.

In another embodiment, the gamma voltage fine-tuning unit 72 generates the M positive polarity driving voltages according to the 2 positive polarity gamma voltages GMAN+1-GMAN+2, and then the timing controller 36 in FIG. 3 adjusts the M positive polarity driving voltages to the N positive polarity driving voltages which are symmetrical to the N negative polarity driving voltages.

Figure 9:
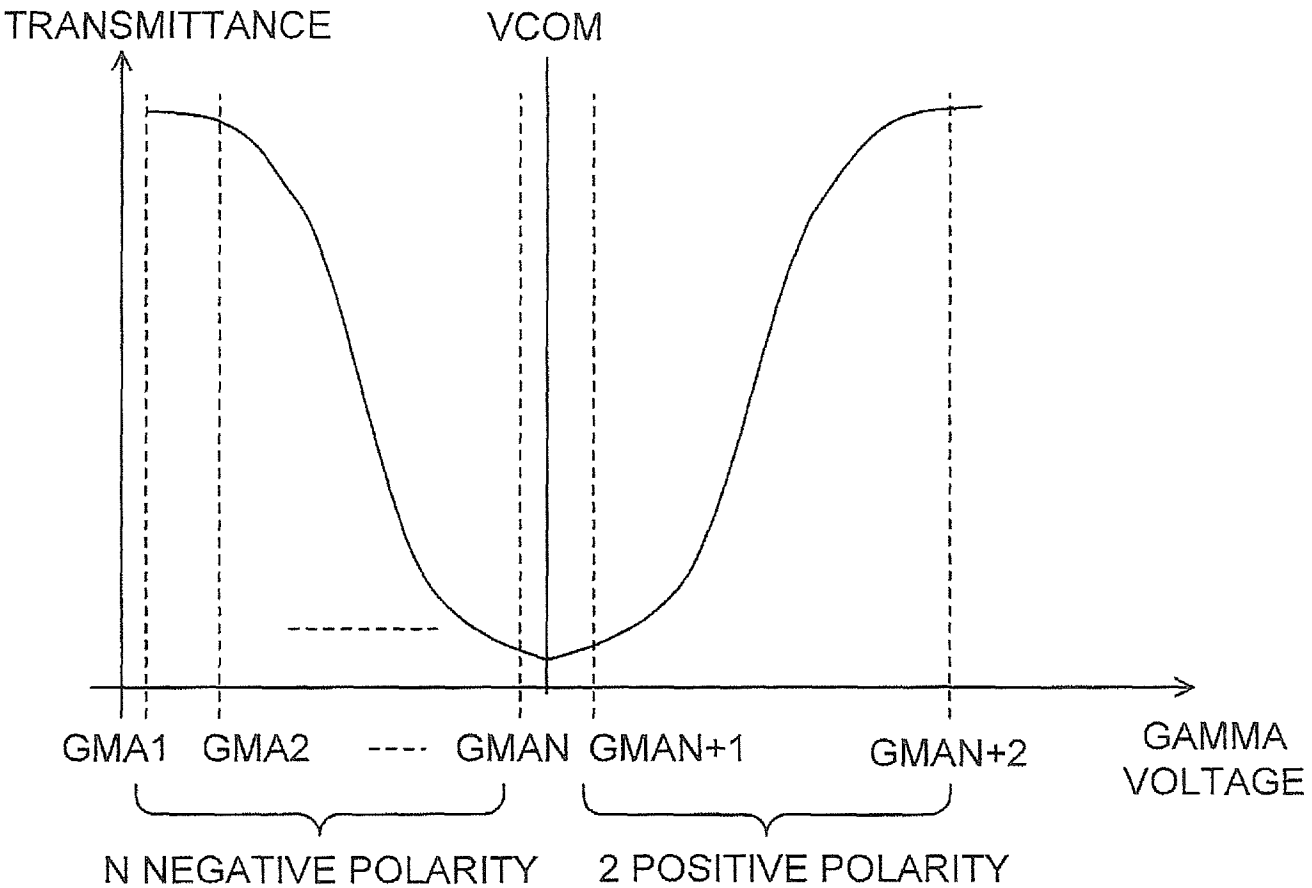
FIG. 9 illustrates relationships of transmittances, the 2 positive polarity gamma voltages GMAN+1-GMAN+2, and the N negative polarity gamma voltages GMA1-GMAN in accordance with the second embodiment of the present invention.

FIG. 9 illustrates relationships of transmittances, the 2 positive polarity gamma voltages GMAN+1-GMAN+2, and the N negative polarity gamma voltages GMA1-GMAN in accordance with the second embodiment of the present invention.

By decreasing the 2N gamma voltages in the prior arts to the N+2 gamma voltages, the adjusting method of the gamma voltage adjusting device of the present invention decreases the number of the gamma ICs on the PCBA for saving the cost.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structure.

What is claimed is:

1. An adjusting method of a gamma voltage adjusting device, the gamma voltage adjusting device utilized for providing a liquid crystal panel with N gray levels and comprising a printed circuit board assembly and a gamma voltage fine-tuning unit, the adjusting method of the gamma voltage adjusting device comprising:

the printed circuit board assembly comprising a plurality of gamma integrated circuits for generating N+2 gamma voltages, the N+2 gamma voltages comprising 2 first polarity gamma voltages and N second polarity gamma voltages, the 2 first polarity gamma voltages respectively corresponding to a highest gray level and a lowest gray level of the N gray levels, and the N second polarity gamma voltages respectively corresponding to the N gray levels;

inputting the 2 first polarity gamma voltages and the N second polarity gamma voltages to the gamma voltage fine-tuning unit; and generating M first polarity driving voltages or N first polarity driving voltages according to the 2 first polarity gamma voltages and generating N second polarity driving voltages according to the N second polarity gamma voltages with the gamma voltage fine-tuning unit, wherein M is less than or equal to N.

2. The adjusting method of the gamma voltage adjusting device of claim 1, wherein the gamma voltage fine-tuning unit comprises a plurality of resistors, and the gamma voltage fine-tuning unit generates the first polarity driving voltages and the second polarity driving voltages by utilizing the resistors to perform a voltage division.

3. The adjusting method of the gamma voltage adjusting device of claim 1, wherein the gamma voltage fine-tuning unit directly generates the N first polarity driving voltages which are symmetrical to the N second polarity driving voltages according to the 2 first polarity gamma voltages.

4. The adjusting method of the gamma voltage adjusting device of claim 1, wherein the gamma voltage fine-tuning unit generates the M first polarity driving voltages according to the 2 first polarity gamma voltages, and a timing controller adjusts the M first polarity driving voltages to the N first polarity driving voltages which are symmetrical to the N second polarity driving voltages.

5. An adjusting method of a gamma voltage adjusting device, the gamma voltage adjusting device utilized for providing a liquid crystal panel with N gray levels and comprising a printed circuit board assembly and a gamma voltage fine-tuning unit, the adjusting method of the gamma voltage adjusting device comprising:

generating N+2 gamma voltages with the printed circuit board assembly, the N+2 gamma voltages comprising 2 negative polarity gamma voltages and N positive polarity gamma voltages, the 2 negative polarity gamma voltages respectively corresponding to a highest gray level and a lowest gray level of the N gray levels, and the N positive polarity gamma voltages respectively corresponding to the N gray levels;

inputting the 2 negative polarity gamma voltages and the N positive polarity gamma voltages to the gamma voltage fine-tuning unit; and generating M negative polarity driving voltages or N negative polarity driving voltages according to the 2 negative polarity gamma voltages and generating N positive polarity driving voltages according to the N positive polarity gamma voltages with the gamma voltage fine-tuning unit, wherein M is less than or equal to N.

6. The adjusting method of the gamma voltage adjusting device of claim 5, wherein the gamma voltage fine-tuning unit comprises a plurality of resistors, and the gamma voltage fine-tuning unit generates the negative polarity driving voltages and the positive polarity driving voltages by utilizing the resistors to perform a voltage division.

7. The adjusting method of the gamma voltage adjusting device of claim 5, wherein the gamma voltage fine-tuning unit directly generates the N negative polarity driving voltages which are symmetrical to the N positive polarity driving voltages according to the 2 negative polarity gamma voltages.

8. The adjusting method of the gamma voltage adjusting device of claim 5, wherein the gamma voltage fine-tuning unit generates the M negative polarity driving voltages according to the 2 negative polarity gamma voltages, and a timing controller adjusts the M negative polarity driving voltages to the N negative polarity driving voltages which are symmetrical to the N positive polarity driving voltages.

9. An adjusting method of a gamma voltage adjusting device, the gamma voltage adjusting device utilized for providing a liquid crystal panel with N gray levels and comprising a printed circuit board assembly and a gamma voltage fine-tuning unit, the adjusting method of the gamma voltage adjusting device comprising:

generating N+2 gamma voltages with the printed circuit board assembly, the N+2 gamma voltages comprising 2 positive polarity gamma voltages and N negative polarity gamma voltages, the 2 positive polarity gamma voltages respectively corresponding to a highest gray level and a lowest gray level of the N gray levels, and the N negative polarity gamma voltages respectively corresponding to the N gray levels;

inputting the 2 positive polarity gamma voltages and the N negative polarity gamma voltages to the gamma voltage fine-tuning unit; and generating M positive polarity driving voltages or N positive polarity driving voltages according to the 2 positive polarity gamma voltages and generating N negative polarity driving voltages according to the N negative polarity gamma voltages with the gamma voltage fine-tuning unit, wherein M is less than or equal to N.

10. The adjusting method of the gamma voltage adjusting device of claim 9, wherein the gamma voltage fine-tuning unit comprises a plurality of resistors, and the gamma voltage fine-tuning unit generates the negative polarity driving voltages and the positive polarity driving voltages by utilizing the resistors to perform a voltage division.

11. The adjusting method of the gamma voltage adjusting device of claim 9, wherein the gamma voltage fine-tuning unit directly generates the N positive polarity driving voltages which are symmetrical to the N negative polarity driving voltages according to the 2 positive polarity gamma voltages.

12. The adjusting method of the gamma voltage adjusting device of claim 9, wherein the gamma voltage fine-tuning unit generates the M positive polarity driving voltages according to the 2 positive polarity gamma voltages, and a timing controller adjusts the M positive polarity driving voltages to the N positive polarity driving voltages which are symmetrical to the N negative polarity driving voltages.

* * * * *